US009993102B2

(12) United States Patent
Silko

(10) Patent No.: US 9,993,102 B2
(45) Date of Patent: Jun. 12, 2018

(54) MAILBOX APPARATUS

(71) Applicant: Nir Silko, Petah Tikva (IL)

(72) Inventor: Nir Silko, Petah Tikva (IL)

( * ) Notice: Subject to any disclaimer, the term of this patent is extended or adjusted under 35 U.S.C. 154(b) by 0 days. days.

(21) Appl. No.: 15/541,017

(22) PCT Filed: Dec. 30, 2014

(86) PCT No.: PCT/IL2014/051138

§ 371 (c)(1),
(2) Date: Jun. 30, 2017

(87) PCT Pub. No.: WO2016/108217

PCT Pub. Date: Jul. 7, 2016

(65) Prior Publication Data

US 2017/0360235 A1 Dec. 21, 2017

(51) Int. Cl.
*A47G 29/12* (2006.01)
*A47G 29/124* (2006.01)

(52) U.S. Cl.
CPC ..... *A47G 29/1201* (2013.01); *A47G 29/124* (2013.01); *A47G 2029/1257* (2017.08)

(58) Field of Classification Search
CPC .. A47G 29/1201; A47G 29/124; A47G 29/20; A47G 29/1209; A47G 2029/1257; E06B 9/115; E05D 15/38; E05D 15/165; E05D 15/24; E05D 2015/225; B65D 43/16
USPC ..... 232/24, 25, 44, 45, 17, 38; 49/197; 312/297; 160/36, 37, 201; 220/812
See application file for complete search history.

(56) References Cited

U.S. PATENT DOCUMENTS 2,131,415 A * 9/1938 Woodward ..... E05F 15/50 16/306
2,739,730 A * 3/1956 Jonas ..... B65F 1/1484 160/201
7,014,096 B2 * 3/2006 Hinds ..... D06F 95/002 160/36
7,913,898 B2 * 3/2011 Frankenberg ..... A47G 29/22 160/36
9,211,025 B1 * 12/2015 Elhawwashy ..... A47G 29/14
2014/0346221 A1 * 11/2014 Pendergast ..... A47G 29/12 232/34

FOREIGN PATENT DOCUMENTS

FR 2599954 A1 * 12/1987 ..... A47G 29/1201

* cited by examiner

*Primary Examiner* — William Miller
(74) *Attorney, Agent, or Firm* — Reuven Mouallem; FlashPoint IP Ltd.

(57) ABSTRACT

The present invention discloses a mailbox apparatus including: a box for accommodating mail, wherein the box includes: two horizontal tracks, each of the tracks disposed at an inner upper part of an opposite sidewall of the box; and two pins, vertically disposed at the same level, each of the pins horizontally disposed at an entry side to one of the tracks; a door having side grooves in side facets of the door positionally corresponding to the pins, wherein the door adapted to have: an open state in which the door is horizontally disposed at an upper inner side of the box, thereby allowing insertion and extraction of the mail; and a closed state in which the door is vertically disposed. Preferably, the apparatus includes: a spring mechanism for applying force on the door while being inserted into the tracks, thereby retaining the door in position upon placing into the tracks.

5 Claims, 8 Drawing Sheets

MAILBOX APPARATUS

FIELD AND BACKGROUND OF THE INVENTION

The present invention relates to the field of mail facilities, particularly to a mailbox apparatus.

Mailboxes for apartment buildings are configured in the form of a box in which the door thereof is pivotally attached to a horizontal hinge disposed at the upper facet of the box. The purpose of such a structure is to keep the mailbox door closed when no force is applied on the door, preventing exposure of the mail to a stranger and/or the elements.

Such a structure has a distinct ergonomic disadvantage. In order to retrieve mail from such a box, a user must hold the door with one hand, while extracting the mail with the other hand. However, when a user has only one hand free (e.g., due to carrying items or an injury), it is preferable be able to access the mailbox door simply with one hand.

A door pivotally connected to a mailbox by a vertical hinge may solve the problem; however, such doors won't close by themselves. Prior-art methods have not provided satisfactory solutions to the problem of single-handedly retrieving mail from a mailbox.

It would be desirable to have a mailbox apparatus that would, inter alia, overcome the various limitations mentioned above.

SUMMARY

It is the purpose of the present invention to provide a mailbox apparatus. It is noted that the term "exemplary" is used herein to refer to examples of embodiments and/or implementations, and is not meant to necessarily convey a more-desirable use-case. Similarly, the terms "preferred" and "preferably" are used herein to refer to an example out of an assortment of contemplated embodiments and/or implementations, and is not meant to necessarily convey a more-desirable use-case. Therefore, it is understood from the above that "exemplary" and "preferred" may be applied herein to multiple embodiments and/or implementations.

Preferred embodiments of the present invention provide a mailbox apparatus for single-handedly retrieving mail from a mailbox.

Therefore, according to the present invention, there is provided a mailbox apparatus (100) including: (a) a box (12) for accommodating mail, wherein the box includes: (i) two horizontal tracks (14), each of the tracks disposed at an inner upper part of an opposite sidewall of the box; and (ii) two pins (18), vertically disposed at the same level, each of the pins horizontally disposed at an entry side to one of the tracks; (b) a door (10) having side grooves (16) in side facets of the door positionally corresponding to the pins, wherein the door is adapted to have: (i) an open state in which the door is horizontally disposed at an upper inner side of the box, thereby allowing insertion and extraction of the mail; and (ii) a closed state in which the door is vertically disposed.

Preferably, the mailbox apparatus further includes: (c) a spring mechanism (34) for applying force on the door while being inserted into the tracks, thereby retaining the door in its position upon placing the door into the tracks.

Preferably, a center-of-gravity (28) of the door is disposed inside the tracks, and wherein the open state corresponds to: (A) the door being disposed into the tracks; and (B) the center-of-gravity of the door is disposed inside the tracks, thereby retaining the door in its position upon placing the door into the tracks such that the center-of-gravity is horizontally inward of the pins toward the rear of the box; and wherein the closed state corresponds to: (A) the grooves hanging on the pins; and (B) the center-of-gravity of the door being disposed out of the tracks, thereby enabling the door to be pulled down by gravity to the closed state upon placing the door such that the center-of-gravity is disposed out of the tracks.

Most preferably, the mailbox apparatus further includes: (c) a spring mechanism (34) for automatically pulling the door into the tracks.

Preferably, each of the tracks expands at a door side of the box.

These and further embodiments will be apparent from the detailed description that follows.

BRIEF DESCRIPTION OF THE DRAWINGS

The present invention is herein described, by way of example only, with reference to the accompanying drawings, wherein.

DESCRIPTION OF THE PREFERRED EMBODIMENTS

The present invention relates to a mailbox apparatus. The principles and operation for providing such a mailbox apparatus, according to the present invention, may be better understood with reference to the accompanying description and the drawings.

Figure 1:
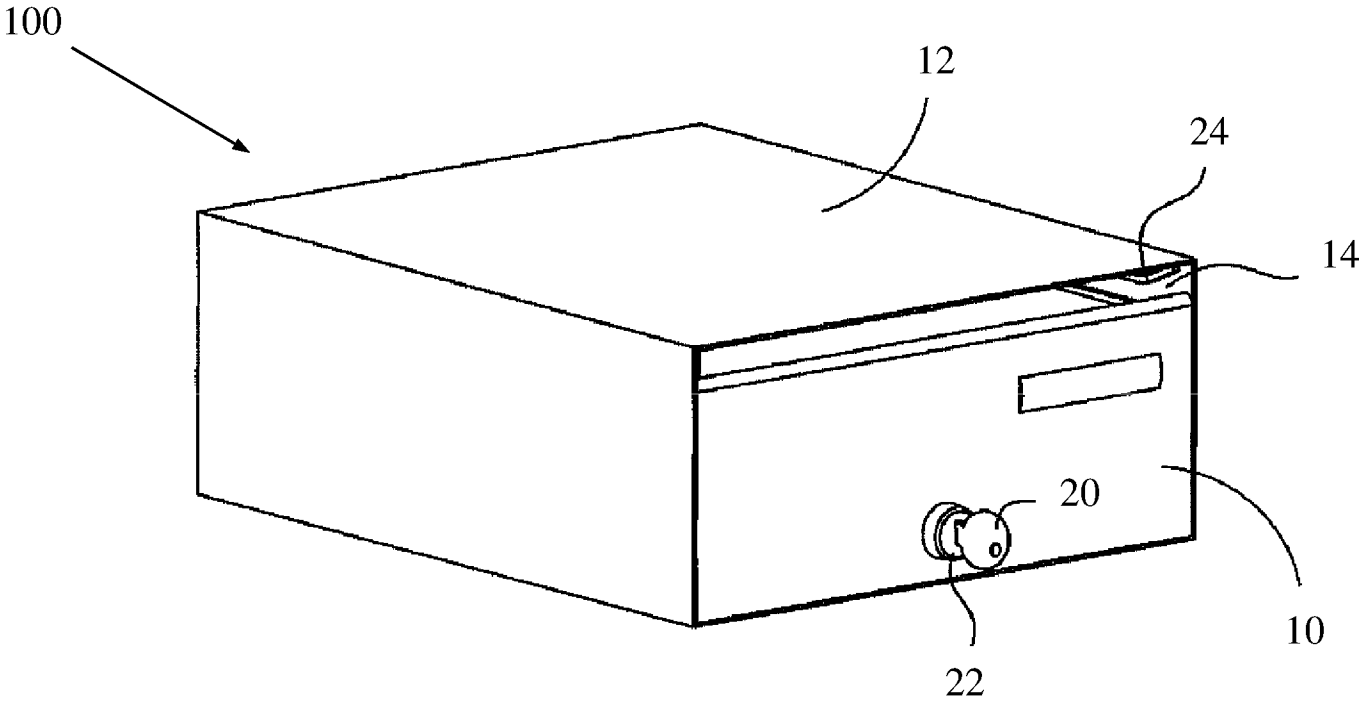
FIG. 1 is a simplified front perspective view of an exemplary mailbox apparatus with the door in the closed position, according to preferred embodiments of the present invention.

Referring to the drawings, FIG. 1 is a simplified front perspective view of an exemplary mailbox apparatus with the door in the closed position, according to preferred embodiments of the present invention. A mailbox apparatus 100 is shown in the form of a box 12 in which a door 10, having grooves 16 on its side facets, is installed. Track 14 (detailed below) on each inner side of box 12 enables door 10 to pivot into an open position, and once opened, to be retracted.

Figure 2:
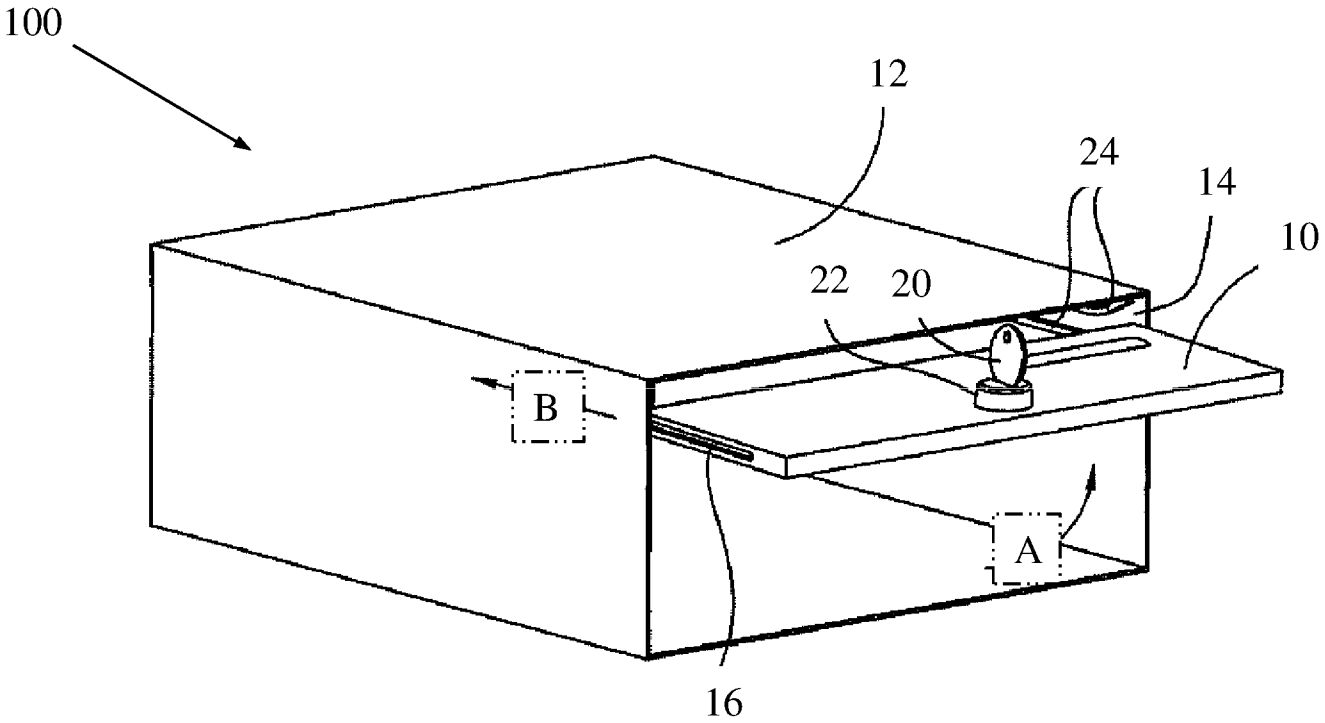
FIG. 2 is a simplified front perspective view of an exemplary mailbox apparatus with the door extended in the open position, according to preferred embodiments of the present invention.

FIG. 2 is a simplified front perspective view of an exemplary mailbox apparatus with the door extended in the open position, according to preferred embodiments of the present invention. Door 10 is shown in a horizontally extended state as a result of being rotated by a user in the direction depicted by an arrow for a position A. From position A, the user pushes the door in the direction depicted by an arrow for a position B until door 10 is in a horizontally retracted state. A key 20 and a lock 22 are optionally shown as well for securing box 12 in preferred embodiments of the present invention.

Figure 3:
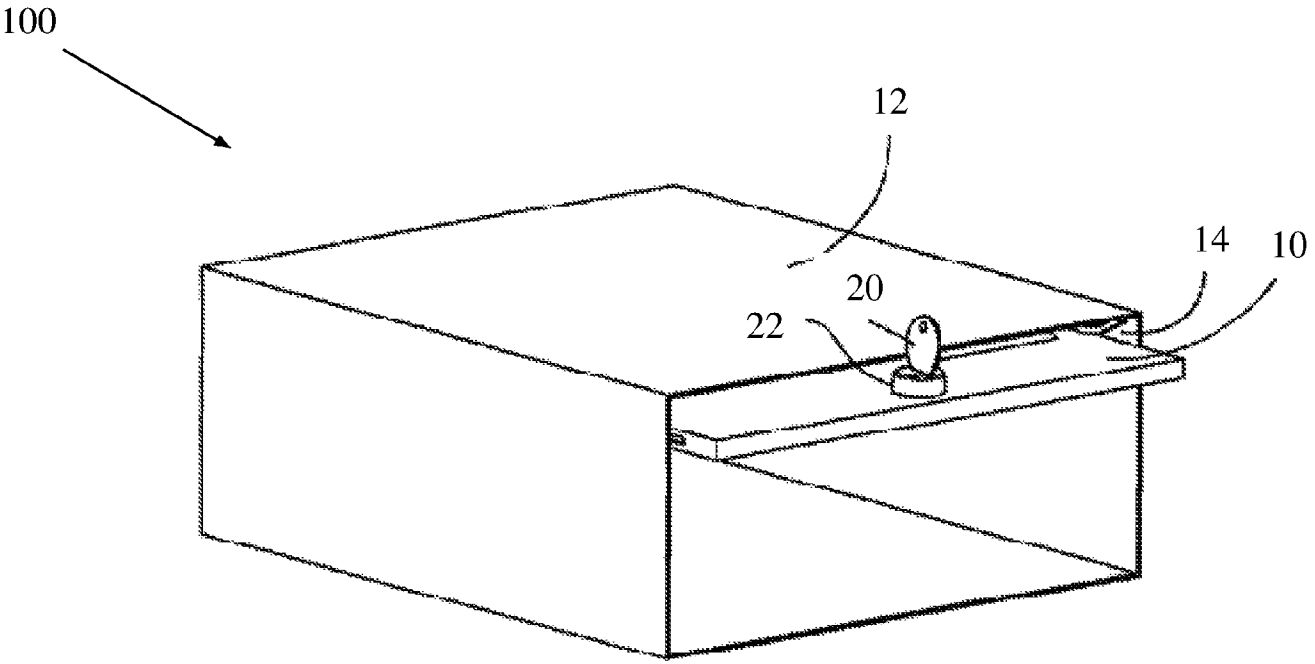
FIG. 3 is a simplified front perspective view of an exemplary mailbox apparatus with the door retracted in the open position, according to preferred embodiments of the present invention.

FIG. 3 is a simplified front perspective view of an exemplary mailbox apparatus with the door retracted in the open position, according to preferred embodiments of the present invention. Door 10 is in a horizontally retracted state (i.e., position B of FIG. 2), allowing mail (e.g., letters and packages) to be inserted or removed. A user can open door 10, remove any mail from box 12, and then close door 10 with the same hand, allowing single-handed operation and access of mailbox apparatus 100.

Figure 4:
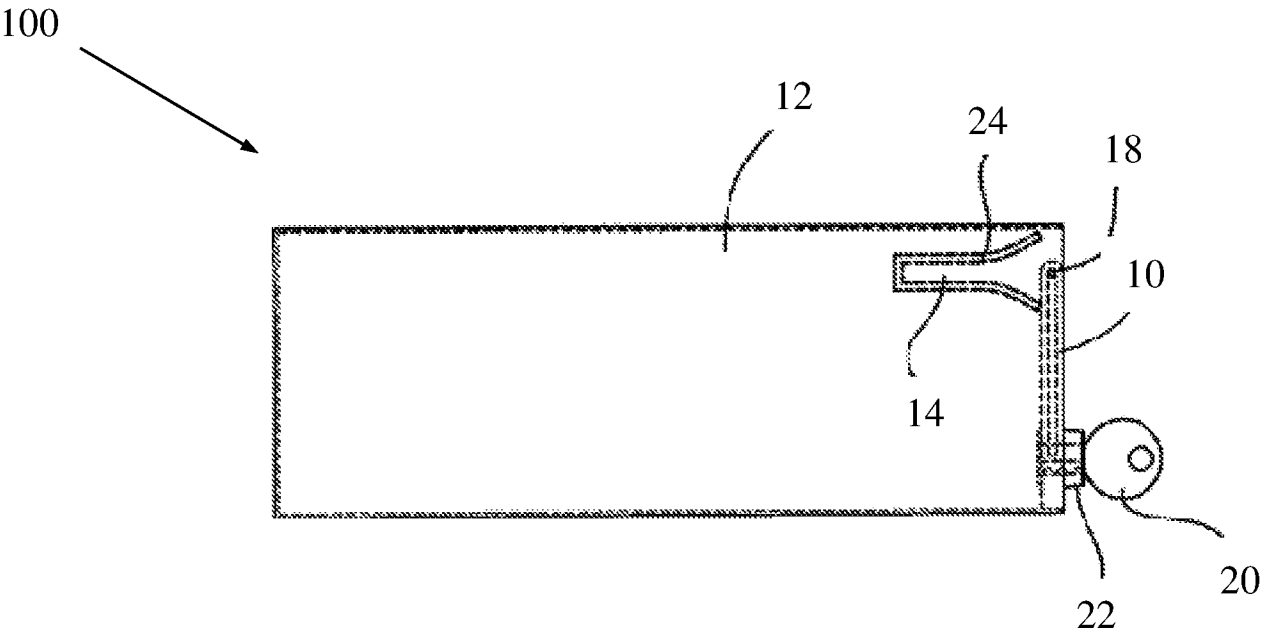
FIG. 4 is a simplified side cross-sectional view of an exemplary mailbox apparatus with the door in the closed position, according to preferred embodiments of the present invention.

FIG. 4 is a simplified side cross-sectional view of an exemplary mailbox apparatus with the door in the closed position, according to preferred embodiments of the present invention. Rails 24 are mounted on the inner side of each of the vertical facets of box 12 forming tracks 14. Tracks 14 expand at the door side of box 12, allowing door 10 to easily engage entry to track 14 upon opening. Two pins 18 mounted on the inner side of box 12 positionally correspond to grooves 16 on the side facets of door 10.

Figure 5:
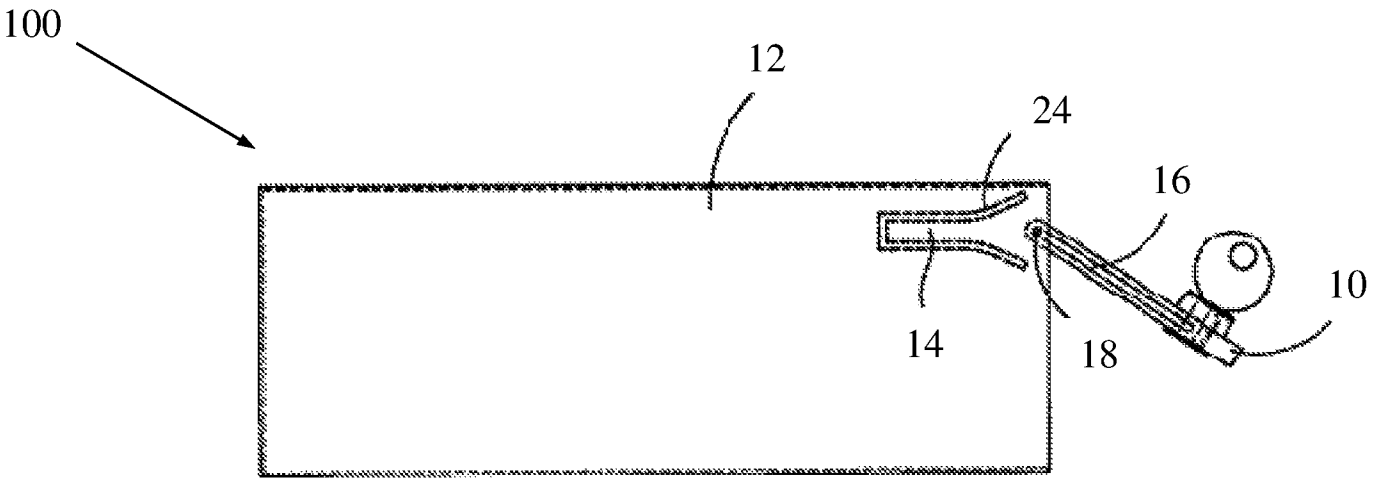
FIG. 5 is a simplified side cross-sectional view of an exemplary mailbox apparatus with the door in a partially-open position, according to preferred embodiments of the present invention.

FIG. 5 is a simplified side cross-sectional view of an exemplary mailbox apparatus with the door in a partially-open position, according to preferred embodiments of the present invention.

Figure 6:
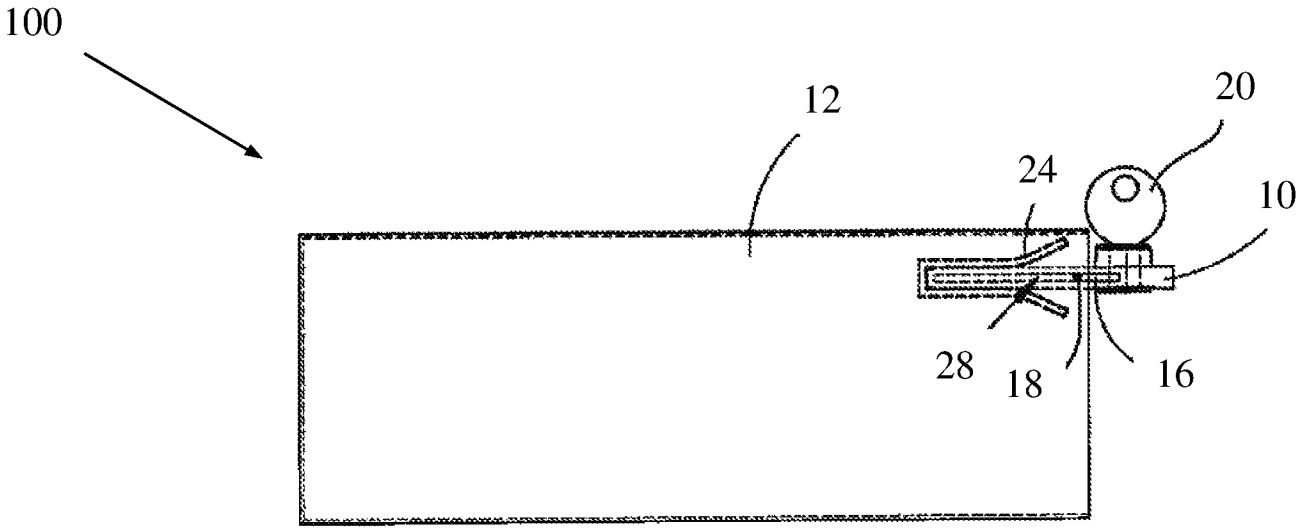
FIG. 6 is a simplified side cross-sectional view of an exemplary mailbox apparatus with the door retracted in the open position, according to preferred embodiments of the present invention.

FIG. 6 is a simplified side cross-sectional view of an exemplary mailbox apparatus with the door retracted in the open position, according to preferred embodiments of the present invention. A center-of-gravity 28 of door 10 is disposed in the left side of pins 18. As a result, when a user leaves door 10 retracted in the open position, door 10 remains in its position until being pulled out by the user, without falling shut while the user is extracting mail.

For example, tracks 14 may apply a force on door 10 in order to keep door 10 in its position. Such a mechanism may employ a spring for this purpose (retaining door 10 inside tracks 14). However, using the mechanism described above, in which center-of-gravity 28 is exploited, such a spring mechanism is not required.

Figure 7:
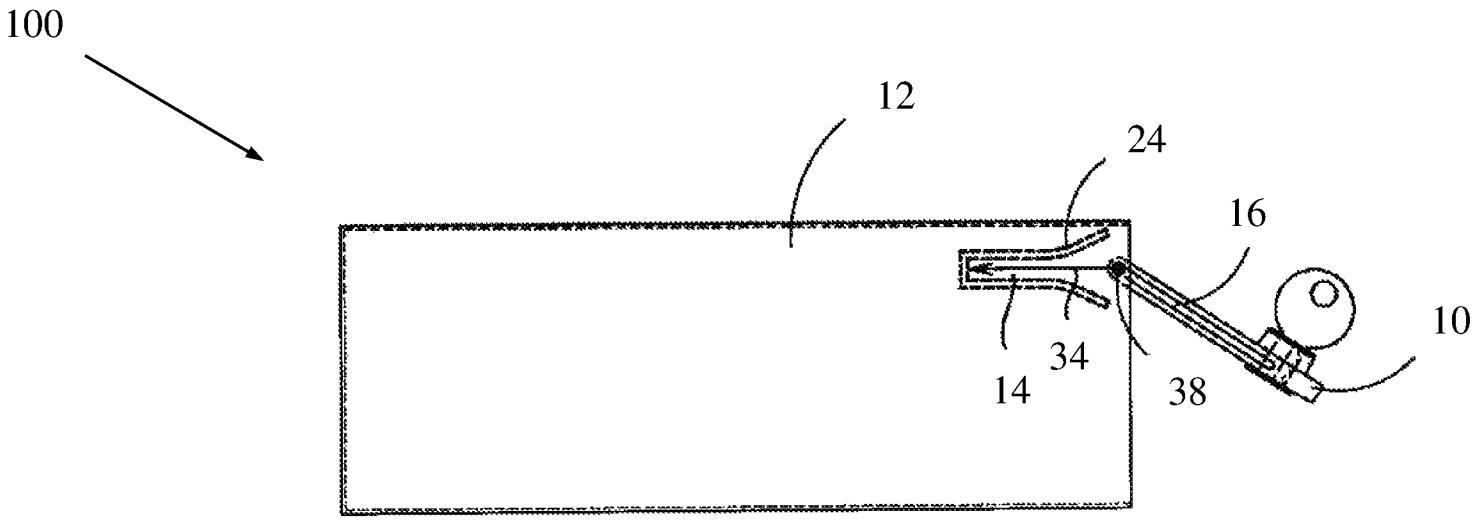
FIG. 7 is a simplified side cross-sectional view of an exemplary mailbox apparatus with a spring-loaded door retracted in partially-open position, according to preferred embodiments of the present invention.

FIG. 7 is a simplified side cross-sectional view of an exemplary mailbox apparatus with a spring-loaded door retracted in partially-open position, according to preferred embodiments of the present invention. A spring 34 (represented as an arrow) pulls door 10 into tracks 14. Thus, once lock 22 is unlocked, door 10 automatically enters tracks 14. In order to lock door 10, a user pulls door 10 by holding key 20, closes door 10, and rotates key 20 in order to secure lock 22. It should be noted that other mechanisms can be adapted to provide the same functionality. The spring mechanism of FIG. 7 is merely exemplary.

Figure 8:
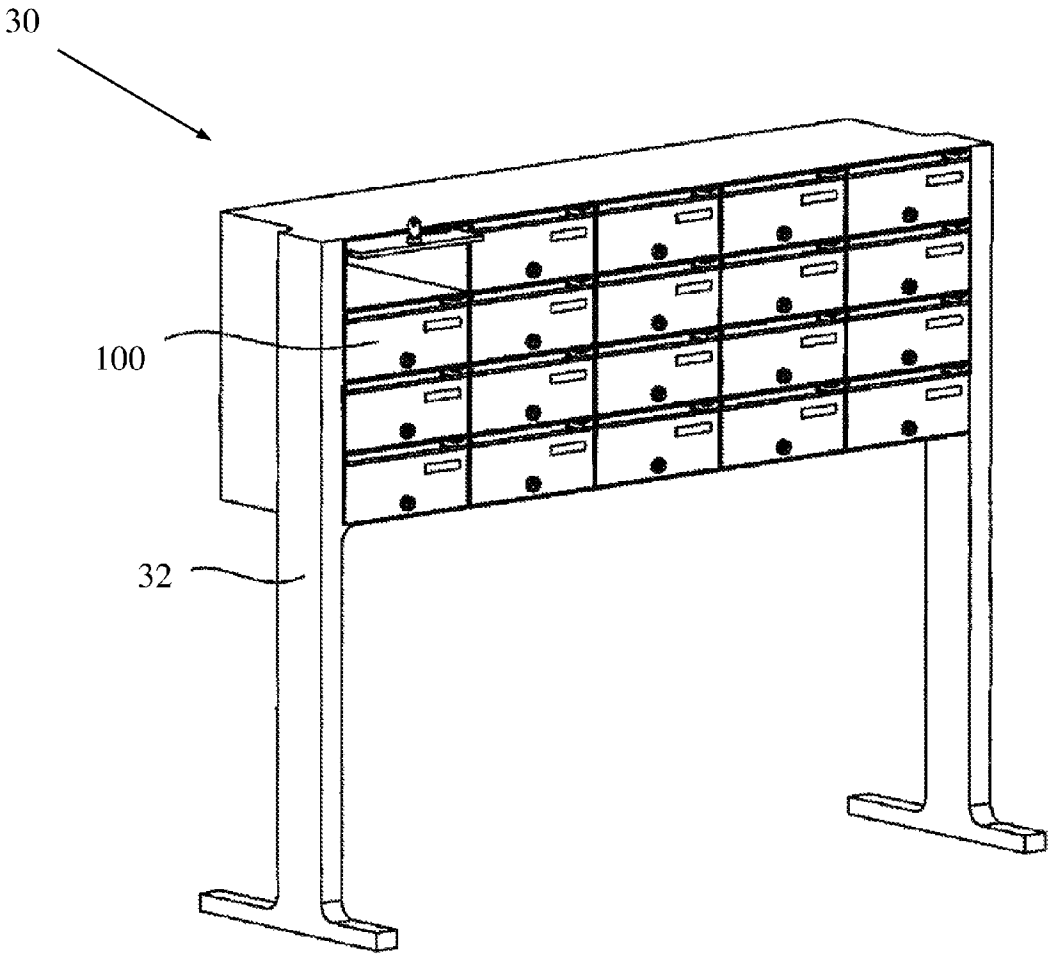
FIG. 8 is a simplified front perspective view of an exemplary mail facility having a plurality of mailbox apparatus, according to preferred embodiments of the present invention.

FIG. 8 is a simplified front perspective view of an exemplary mail facility having a plurality of mailbox apparatus, according to preferred embodiments of the present invention. A mail facility 30 is shown with a plurality of mailbox apparatus 100 disposed on a stand 32.

While the present invention has been described with respect to a limited number of embodiments, it will be appreciated that many variations, modifications, and other applications of the present invention may be made.

What is claimed is:

1. A mailbox apparatus, the apparatus comprising:

(a) a box for accommodating mail, wherein said box includes:

(i) two horizontal tracks, each of said tracks disposed at an inner upper part of an opposite sidewall of said box; and (ii) two pins, vertically disposed at the same level, each of said pins horizontally disposed at an entry side to one of said tracks;

(b) a door having side grooves in side facets of said door positionally corresponding to, and adapted to slide cooperatively with, said pins, wherein said door is adapted to move between:

(i) an open state in which said door is horizontally disposed at an upper inner side of said box, thereby allowing insertion and extraction of said mail; and (ii) a closed state in which said door is vertically disposed.

2. The mailbox apparatus of claim 1 further comprising:

(c) a spring mechanism for applying force on said door while being inserted into said tracks, thereby retaining said door in its position upon placing said door into said tracks.

3. The mailbox apparatus of claim 1, wherein a center-of-gravity of said door is disposed inside said tracks, and wherein said open state corresponds to:

(A) said door being disposed into said tracks; and (B) said center-of-gravity of said door is disposed inside said tracks, thereby retaining said door in its position upon placing said door into said tracks such that said center-of-gravity is horizontally inward of said pins toward the rear of said box; and wherein said closed state corresponds to:

(A) said grooves hanging on said pins; and (B) said center-of-gravity of said door being disposed out of said tracks, thereby enabling said door to be pulled down by gravity to said closed state upon placing said door such that said center-of-gravity is disposed out of said tracks.

4. The mailbox apparatus of claim 3 further comprising:

(c) a spring mechanism for automatically pulling said door into said tracks.

5. The mailbox apparatus of claim 1, wherein each of said tracks expands at said entry side.

* * * * *